US012202028B2

(12) United States Patent
Shinno et al.

(10) Patent No.: US 12,202,028 B2
(45) Date of Patent: Jan. 21, 2025

(54) METHOD FOR JOINING MEMBERS, AND COMPOSITE ELASTIC BODY USED IN SAID METHOD

(71) Applicant: KABUSHIKI KAISHA KOBE SEIKO SHO (KOBE STEEL, LTD.), Hyogo (JP)

(72) Inventors: Koichiro Shinno, Kobe (JP); Yasuhiro Maeda, Kobe (JP)

(73) Assignee: KABUSHIKI KAISHA KOBE SEIKO SHO (KOBE STEEL, LTD.), Hyogo (JP)

( * ) Notice: Subject to any disclaimer, the term of this patent is extended or adjusted under 35 U.S.C. 154(b) by 0 days.

(21) Appl. No.: 18/568,557

(22) PCT Filed: Apr. 20, 2022

(86) PCT No.: PCT/JP2022/018318
§ 371 (c)(1),
(2) Date: Dec. 8, 2023

(87) PCT Pub. No.: WO2023/276419
PCT Pub. Date: Jan. 5, 2023

(65) Prior Publication Data

US 2024/0269727 A1 Aug. 15, 2024

(30) Foreign Application Priority Data

Jun. 28, 2021 (JP) ..... 2021-107023

(51) Int. Cl.
*B21D 39/20* (2006.01)
*B21D 37/01* (2006.01)
*B21D 39/06* (2006.01)

(52) U.S. Cl.
CPC ..... *B21D 39/206* (2013.01); *B21D 37/01* (2013.01); *B21D 39/06* (2013.01)

(58) Field of Classification Search
CPC .... B21D 39/203; B21D 39/06; B21D 39/206; B21D 37/01; Y10T 29/49375; Y10T 29/4994; Y10T 29/53122; Y10T 29/5367
See application file for complete search history.

(56) References Cited

U.S. PATENT DOCUMENTS 3,432,916 A * 3/1969 Reichert ..... B21D 39/206 29/523
4,418,457 A * 12/1983 Mueller ..... B21D 39/203 29/523

(Continued)

FOREIGN PATENT DOCUMENTS

JP S54-008155 A 1/1979
JP S60-071435 U 5/1985

(Continued)

OTHER PUBLICATIONS

Mesteel, Steel Hardness Conversion Table (Year: 2003).*

(Continued)

*Primary Examiner* — Lee A Holly
(74) *Attorney, Agent, or Firm* — Studebaker & Brackett PC

(57) ABSTRACT

A first member provided with a hole, a second member having a tubular shape, and a composite elastic body obtained by combining at least two types of elastic bodies having different hardness are prepared, the second member is inserted into the hole of the first member, the composite elastic body is inserted into the second member, and the composite elastic body is pressed to cause the second member to bulge out, thereby joining the first member and the second member by press-fitting.

9 Claims, 8 Drawing Sheets

(56) References Cited

U.S. PATENT DOCUMENTS

| | | | | |
|---|---|---|---|---|
| 2018/0015527 | A1 | 1/2018 | Maeda et al. | |
| 2019/0070656 | A1* | 3/2019 | Watanabe | B21D 39/20 |
| 2019/0210088 | A1 | 7/2019 | Maeda et al. | |
| 2019/0210089 | A1 | 7/2019 | Maeda et al. | |

FOREIGN PATENT DOCUMENTS

| | | | |
|---|---|---|---|
| JP | 2016-147309 | A | 8/2016 |
| WO | 2017/169298 | A1 | 10/2017 |

OTHER PUBLICATIONS

International Preliminary Report on Patentability and Written Opinion issued in PCT/JP2022/018318; mailed Jan. 11, 2024.
International Search Report issued in PCT/JP2022/018318; mailed Jun. 28, 2022.

* cited by examiner

METHOD FOR JOINING MEMBERS, AND COMPOSITE ELASTIC BODY USED IN SAID METHOD

CROSS-REFERENCE TO RELATED APPLICATIONS

This is a national phase application in the United States of International Patent Application No. PCT/JP2022/018318 with an international filing date of Apr. 20, 2022, which claims priority of Japanese Patent Application No. 2021-107023 filed on Jun. 28, 2021, the contents of which are incorporated herein by reference.

TECHNICAL FIELD

The present invention relates to a method for joining members and a composite elastic body used in the method.

BACKGROUND ART

A high-strength steel plate called high tensile strength steel is used for weight reduction and safety improvement of automobiles. The high tensile strength steel is effective for weight reduction and safety improvement, but the high tensile strength steel is heavier than low specific gravity materials such as aluminum. In addition, the use of high tensile strength steel causes problems such as a decrease in formability, an increase in forming load, and a decrease in dimensional accuracy because of its high strength. To solve these problems, in recent years, multi-materialization has been performed in which an extruded product, a cast product, or a press-molded product using aluminum having a lower specific gravity than steel is used together with a steel component.

A problem in multi-materialization is joining of dissimilar metals such as steel components and aluminum components. It is usually difficult to join dissimilar metals having different properties as described above, but for example, JP 2016-147309 A discloses a method for joining members that enables joining of dissimilar metals in multi-materialization by using an elastic body. Specifically, the method for joining members of JP 2016-147309 A includes inserting a tube body into a hole of a plate member, inserting an elastic body into the tube body, deforming the elastic body by applying pressure to expand the tube body, and joining the plate member and the tube body by press-fitting.

SUMMARY OF THE INVENTION

The joining method disclosed in JP 2016-147309 A may cause local deformation at an end of the elastic body when the elastic body inserted into the tube body is pressed. When the local deformation is large, permanent strain or cracking may occur in the elastic body. Thus, it is necessary to limit the amount of pressing against the elastic body, and as a result, the tube expansion amount of the tube body is also limited, which may result in unfirm joining by press-fitting.

In addition, when the elastic body is pressed, and there is a large frictional force between the elastic body and the inner surface of the tube body, the pressing force is not uniformly transmitted to the entire region of the elastic body, which may cause uneven deformation of the elastic body. As a result, the tube body may also be unevenly deformed, which may result in unfirm joining by press-fitting.

An object of the present invention is to provide a method for joining members capable of sufficiently deforming an elastic body and firmly joining a first member and a second member when the first member provided with a hole and the second member having a tubular shape are subjected to joining by press-fitting using the elastic body, and a composite elastic body used in the method.

A first aspect of the present invention provides a method for joining members, the method including preparing a first member provided with a hole, a second member having a tubular shape, and a composite elastic body obtained by combining at least two types of elastic bodies having different hardness, inserting the second member into the hole of the first member, inserting the composite elastic body into the second member, and pressing the composite elastic body to cause the second member to bulge out, thereby joining the first member and the second member by press-fitting.

According to this method, using the composite elastic body makes it possible to firmly join the first member and the second member as described below. Assuming that an elastic body made of a uniform material is used, the elastic body is locally and largely deformed at a portion receiving relatively large stress and frictional force. When the composite elastic body is used, it is possible to prevent local and large deformation by disposing an elastic body having relatively high hardness at a portion receiving a relatively large stress. In addition, since an elastic body having relatively low hardness has a small friction coefficient, it is possible to prevent local and large deformation by disposing the elastic body having low hardness at a portion receiving a relatively large frictional force. This makes it possible to prevent the occurrence of permanent strain and cracking associated with local deformation in the composite elastic body. Thus, the amount of pressing against the composite elastic body can be increased, the bulge amount of the second member can be increased, and the first member and the second member can be firmly joined. The hardness may be determined based on a numerical value of Shore A, for example.

The composite elastic body may have a columnar shape including a first end surface having a flat shape and a second end surface having a flat shape, the first end surface and the second end surface receiving a pressing force in such a manner as to be sandwiched, and a side surface connecting the first end surface and the second end surface, and the composite elastic body may include a first elastic body having relatively high hardness and a second elastic body having relatively low hardness.

According to the above method, the portion receiving a pressing force in the composite elastic body is formed of flat surfaces (the first end surface and the second end surface). Thus, the composite elastic body can uniformly receive the pressing force on the flat surfaces (the first end surface and the second end surface). Thus, the composite elastic body can be uniformly deformed.

The first elastic body may constitute a first edge that is a connecting portion between the first end surface and the side surface, and a second edge that is a connecting portion between the second end surface and the side surface.

According to the above method, the first edge and the second edge of the composite elastic body to which a large force is applied in pressing are formed of the first elastic body, which makes it possible to prevent local and large deformation of the composite elastic body. Thus, the amount of pressing against the composite elastic body can be increased, the bulge amount of the second member can be increased, and the first member and the second member can be firmly joined.

The second elastic body may constitute at least a part of the side surface.

According to the above method, at least a part of a portion where the composite elastic body and the second member are in contact with each other is formed of the second elastic body having a relatively small friction coefficient. Thus, the frictional force generated between the composite elastic body and the second member can be reduced. Thus, it is possible to prevent the composite elastic body from being unintentionally deformed by the frictional force, and thus, a larger pressing force can be applied to the composite elastic body. Thus, the bulge amount of the second member can be increased, and the first member and the second member can be firmly joined.

The second elastic body may constitute at least a part of the first end surface and at least a part of the second end surface.

According to the above method, the frictional force generated on the first end surface and the second end surface can be reduced. Frictional force is generated perpendicular to a direction of the pressing force on the first end surface and the second end surface that receive the pressing force. This frictional force prevents deformation of the first end surface and the second end surface in a direction perpendicular to the direction of the pressing force of the composite elastic body. Forming at least a part of the first end surface and the second end surface by using the second elastic body can reduce the frictional force and increase the amount deformation of the first end surface and the second end surface in the direction perpendicular to the direction of the pressing force of the composite elastic body. Thus, the amount of deformation in the first end surface and the second end surface that are relatively difficult to deform can be increased, and thus, the second member can be uniformly deformed.

A boundary between the first elastic body and the second elastic body may be formed of a curved surface.

According to the above method, stress concentration at the boundary between the first elastic body and the second elastic body can be reduced. Assuming that a corner portion is provided at the boundary between the first elastic body and the second elastic body, stress concentrates on the corner portion at the time of pressing, and the first elastic body or the second elastic body may be cracked. Since the boundary between the first elastic body and the second elastic body is formed of a curved surface, stress concentration is reduced, which prevents occurrence of cracking. Thus, the durability of the composite elastic body can improve.

The method may further include further preparing a pusher that includes a drive surface for pressing the first end surface and is driven in a direction perpendicular to the first end surface, and a receiver that includes a fixing surface for supporting the second end surface and is positionally fixed, and pressing the composite elastic body to sandwich the composite elastic body between the drive surface of the pusher and the fixing surface of the receiver, wherein the first elastic body may have a tapered columnar shape extending from the first end surface to the second end surface, and the second elastic body may be disposed around the first elastic body and may constitute a whole of the side surface.

According to the above method, since the second elastic body is disposed at the entire side surface, the frictional force generated between the composite elastic body and the second member is reduced, and uniform deformation of the composite elastic body can be promoted. In addition, since the pressing force applied from the pusher to the composite elastic body is less likely to be transmitted as it comes toward the second end surface because of the frictional force, the composite elastic body is less likely to be deformed on the second end surface side. Since the first elastic body is tapered toward the second end surface and the thickness of the second elastic body decreases toward the second end surface, the rigidity of the composite elastic body decreases toward the second end surface. Thus, the deformation of the composite elastic body on the second end surface side is promoted, and thus, uniform deformation of the composite elastic body can be promoted.

The method may further include further preparing a pusher that includes a drive surface for pressing the first end surface and is driven in a direction perpendicular to the first end surface, and a receiver that includes a fixing surface for supporting the second end surface and is positionally fixed, disposing a lower surface of the second member and the second end surface of the composite elastic body to make the lower surface and the second end surface flush with each other on the fixing surface of the receiver, and pressing the composite elastic body to sandwich the composite elastic body between the drive surface of the pusher and the fixing surface of the receiver, wherein the second elastic body may constitute a whole of the second end surface and a part of the first end surface.

According to the above method, uniform deformation of the composite elastic body can be promoted. In pressing from the first end surface side, the first end surface receives a relatively large force, and the second end surface receives a relatively small force. The second elastic body constitutes the entire second end surface and a part of the first end surface in accordance with such a difference in relative received force. That is, the proportion of the second elastic body is larger on the second end surface side than on the first end surface side. Thus, uniform deformation of the composite elastic body can be promoted.

A second aspect of the present invention provides a composite elastic body disposed in a second member and pressed in a state where the second member is inserted into a hole of a first member, the composite elastic body causing the second member to bulge out, to join the first member provided with the hole and the second member having a tubular shape by press-fitting, the composite elastic body including at least two types of elastic bodies having different hardness.

With this configuration, using the composite elastic body makes it possible to firmly join the first member and the second member as described below. Assuming that an elastic body made of a uniform material is used, the elastic body is locally and largely deformed at a portion receiving relatively large stress and frictional force. When the composite elastic body is used, it is possible to prevent local and large deformation by disposing an elastic body having relatively high hardness at a portion receiving a relatively large stress. In addition, since an elastic body having relatively low hardness has a small friction coefficient, it is possible to prevent local and large deformation by disposing the elastic body having low hardness at a portion receiving a relatively large frictional force. This makes it possible to prevent the occurrence of permanent strain and cracking associated with local deformation in the composite elastic body. Thus, the amount of pressing against the composite elastic body can be increased, the bulge amount of the second member can be increased, and the first member and the second member can be firmly joined. The hardness may be determined based on a numerical value of Shore A, for example.

According to the method for joining members and the composite elastic body used in the method according to the present invention, the composite elastic body can be sufficiently deformed when the first member provided with the hole and the second member having a tubular shape are subjected to joining by press-fitting using the composite elastic body. Thus, the first member and the second member can be firmly joined.

DETAILED DESCRIPTION

Hereinafter, embodiments of the present invention will be described with reference to the accompanying drawings. In the following description, terms representing directions and positions (for example, "upper side" and "lower side") may be used, but these terms are used to facilitate understanding of the invention, and the technical scope of the present invention is not limited by the meaning of these terms. The following description is merely an example of an embodiment of the present invention, and is not intended to limit the present invention, its application, or its use.

In each embodiment described below, materials of individual members are exemplified, but the materials of individual members are not particularly limited to those exemplified in all the embodiments, and the present invention can be applied to any material.

First Embodiment

Figure 1:
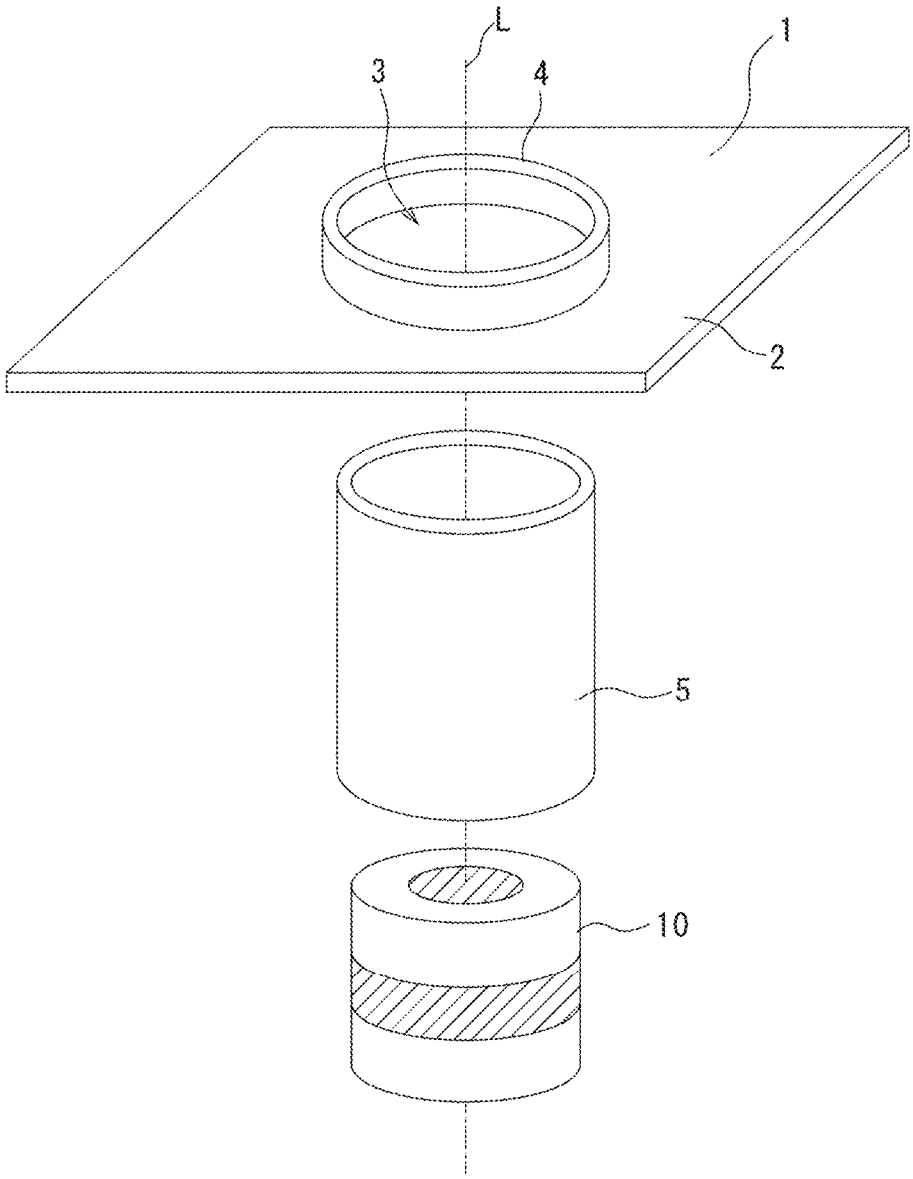
FIG. 1 is a perspective view of a wall surface body, a tube body, and a composite elastic body to which a method for joining members according to a first embodiment of the present invention is applied.
Figure 2:
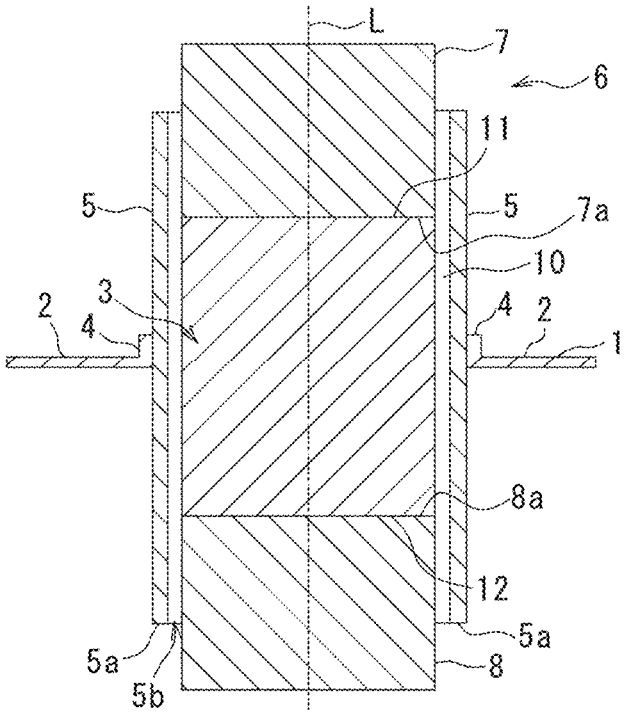
FIG. 2 is a schematic sectional view showing the wall surface body and the tube body of FIG. 1 before joining by press-fitting.
Figure 3:
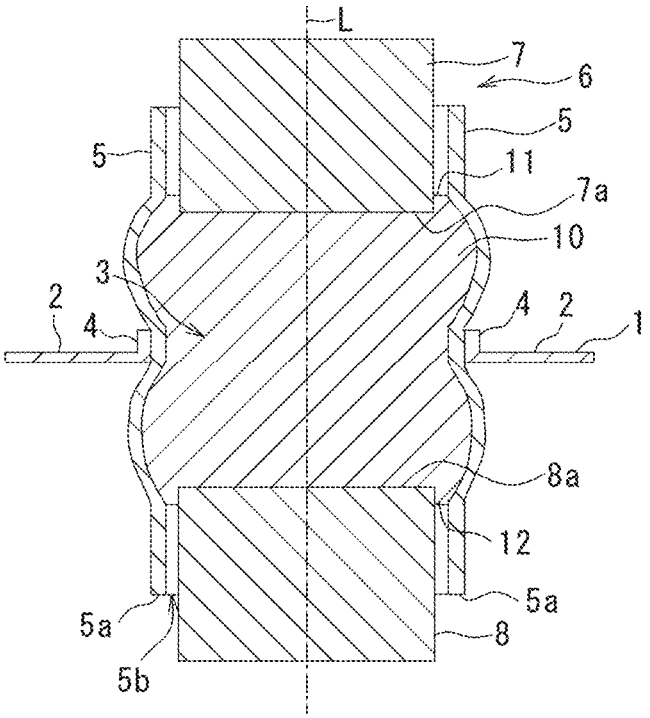
FIG. 3 is a schematic sectional view showing the wall surface body and the tube body of FIG. 1 after joining by press-fitting.

With reference to FIGS. 1 to 3, a method for joining members in which a wall surface body (a first member) 1 and a tube body (a second member) 5 are joined by press-fitting will be described.

In the present embodiment, the wall surface body 1 is a substantially flat-plate-shaped component made of high tensile strength steel. The wall surface body 1 includes a main body 2 having a plate shape, a hole 3 provided in the main body 2 and through which the tube body 5 is to be inserted, and an abutting portion 4 provided along the periphery of the hole 3. The abutting portion 4 is formed by burring the hole 3. The shape of the wall surface body 1 is not limited to a flat plate shape, and the shape may be any shape having a hole. The hole 3 does not have to be subjected to burring.

The tube body 5 is a tubular component made of an aluminum alloy and having a circular section. The tube body 5 extends in an axis L direction. The axis L passes through the center of the tube body 5 and the center of the hole 3 of the wall surface body 1.

As shown in FIG. 3, the tube body 5 bulges out from the inside to the outside in the upper and lower regions of the abutting portion 4 of the wall surface body 1, and bulging is prevented by the wall surface body 1 at the abutting portion 4, and thus, the tube body 5 is joined to the hole 3 of the wall surface body 1 by press-fitting. The shape and dimensions of the hole 3 of the wall surface body 1 are similar to a sectional shape of the tube body 5, and they are preferably as small as possible within a range in which the tube body 5 can be inserted.

Figure 4:
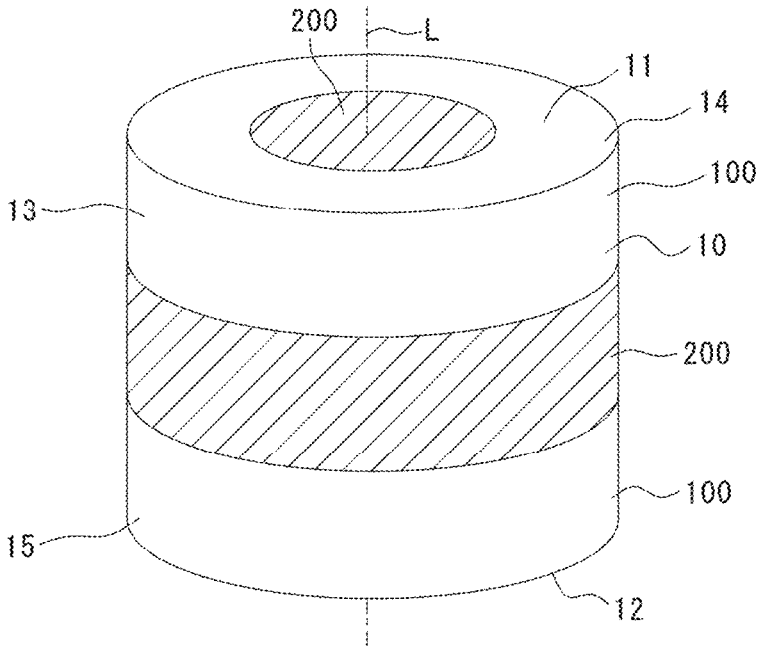
FIG. 4 is a perspective view of a composite elastic body according to the first embodiment of the present invention.

With reference also to FIG. 4, the wall surface body 1 and the tube body 5 are joined by press-fitting using the composite elastic body 10. The composite elastic body 10 is a combination of two types of elastic bodies (a first elastic body 100 and a second elastic body 200) having different hardness. The first elastic body 100 has relatively high hardness, and the second elastic body 200 has relatively low hardness. In the present embodiment, the hardness is determined, for example, based on the numerical value of Shore A. In the present embodiment, the value of the Shore A of the first elastic body 100 is, for example, 95, and the value of the Shore A of the second elastic body 200 is, for example, 50.

The composite elastic body 10 has a columnar shape including a flat first end surface 11 that constitutes an upper surface, a flat second end surface 12 that constitutes a lower surface opposite to the first end surface 11, and a side surface 13 connecting the first end surface 11 and the second end surface 12. In the present embodiment, the composite elastic body 10 has a circular columnar shape with a diameter that can be inserted into the tube body 5. In the present embodiment, the length of the composite elastic body 10 is shorter than the length of the tube body 5 in the axis L direction. Thus, in a state where the composite elastic body 10 and the tube body 5 are set, the composite elastic body 10 is housed inside the tube body 5.

Figure 5:
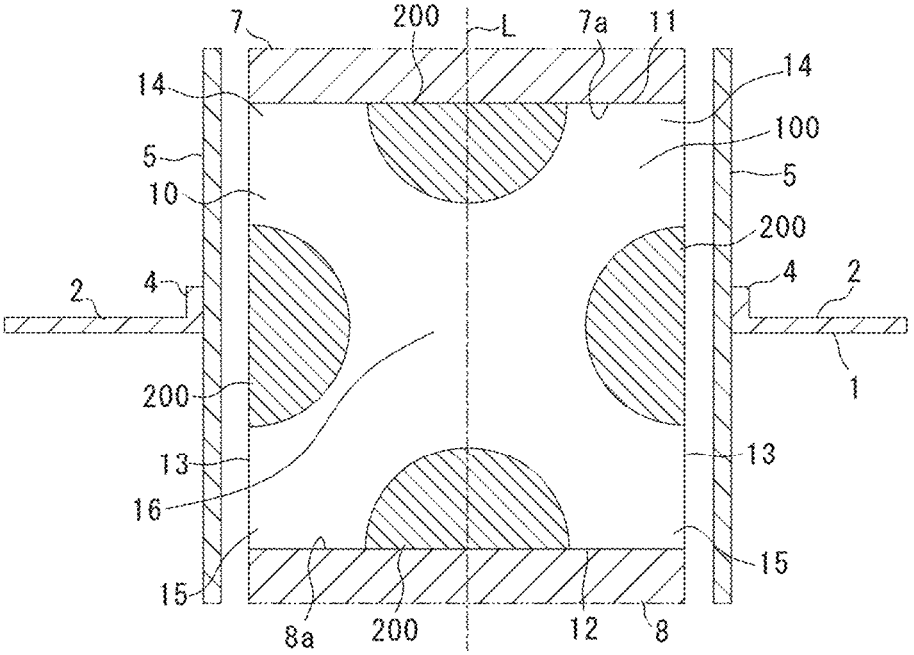
FIG. 5 is a sectional view taken along the axis L in FIG. 4

FIG. 5 is a sectional view taken along the axis L of the composite elastic body 10. The second elastic body 200 is hatched to indicate a cross section, but hatching is omitted for the first elastic body 100 for clarity of illustration.

With reference to FIGS. 4 and 5, the first elastic body 100 constitutes a first edge 14 which is a connection portion between the first end surface 11 and the side surface 13, a second edge 15 which is a connection portion between the second end surface 12 and the side surface 13, and a central portion 16 which is near the center of gravity of the composite elastic body 10. In the present embodiment, the second elastic body 200 is annularly disposed to constitute a part of the side surface 13 of the composite elastic body 10. In addition, the second elastic body 200 is disposed to constitute a part of the first end surface 11 and a part of the second end surface 12 of the composite elastic body 10.

The sectional shape of the second elastic body 200 is a semicircular shape. In other words, the boundary between the first elastic body 100 and the second elastic body is formed of a curved surface.

The first elastic body 100 and the second elastic body 200 are separately formed in the present embodiment, but alternatively, they are not required to be separately formed, and they may be integrally formed.

A method for joining the wall surface body 1 and the tube body 5 will be described with reference to FIGS. 2 and 3.

First, as shown in FIG. 2, the tube body 5 is inserted into the hole 3 of the wall surface body 1, and the composite elastic body 10 is inserted into the tube body 5 and set in a press device 6. The tube body 5 may be inserted into the hole 3 in a state where the composite elastic body 10 is inserted into the tube body 5.

The press device 6 includes a pusher 7 and a receiver 8. In the present embodiment, the pusher 7 is driven in a direction perpendicular to the first end surface 11, that is, in the vertical direction, and the receiver 8 is fixed. In a state of being set in the press device 6, the wall surface body 1, the tube body 5, and the composite elastic body 10 have a common central axis coinciding with the axis L, and the central axis is disposed along the vertical direction. The pusher 7 is partially inserted into the tube body 5 from above, and the receiver 8 is partially inserted into the tube body 5 from below. The pusher 7 includes a drive surface 7*a* which is a flat lower surface, and the drive surface 7*a* presses the first end surface 11 of the composite elastic body 10. The receiver 8 includes a fixing surface 8*a* which is a flat upper surface, and the composite elastic body 10 is placed such that the second end surface 12 is in contact with the fixing surface 8*a*. Alternatively, the press device 6 may be configured such that both the pusher 7 and the receiver 8 are driven to press. The press device 6 may also be configured to press in the horizontal direction, for example.

In the present embodiment, sectional shape perpendicular to the axis L of the pusher 7 and the receiver 8 are similar to a sectional shape perpendicular to the axis L of the tube body 5, that is, circular shapes. The diameters of the pusher 7 and the receiver 8 are slightly smaller than the inner diameter of the tube body 5. This allows the pusher 7 and the receiver 8 to be inserted into the tube body 5 and press the composite elastic body 10 from above and below. The diameters of the pusher 7 and the receiver 8 are preferably as large as possible within a range in which the pusher 7 and the receiver 8 can be inserted into the tube body 5.

Next, as shown in FIG. 3, a compressive external force is applied to the composite elastic body 10 in the axis L direction by the pusher 7 and the receiver 8. Specifically, the pusher 7 is lowered downward while the receiver 8 is not moved, and a pressing force is applied in such a manner as to sandwich the first end surface 11 and the second end surface 12. As the dimension of the composite elastic body 10 in the axis L direction decreases, the dimension in the radial direction increases. In this manner, the composite elastic body 10 is pressed to elastically deform (bulge out) outward from the axis L, whereby the tube body 5 is caused to bulge out and is joined to the wall surface body 1 by press-fitting.

After the joining by press-fitting, the composite elastic body 10 from which the compressive force from the pusher 7 and the receiver 8 is removed is restored to the original shape as shown in FIG. 2 by its own elastic force and can be easily removed from the tube body 5.

According to the method for joining members of the present embodiment, the wall surface body 1 and the tube body 5 can be firmly joined as described below by using the composite elastic body 10. Assuming that an elastic body made of a uniform material is used, the elastic body is locally and largely deformed at a portion receiving relatively large stress and frictional force. When the composite elastic body 10 is used, it is possible to prevent local and large deformation by disposing an elastic body having relatively high hardness (the first elastic body 100) at a portion receiving a relatively large stress. In addition, since an elastic body having relatively low hardness (the second elastic body 200) has a small friction coefficient, it is possible to prevent local and large deformation by disposing the second elastic body 200 at a portion receiving a relatively large frictional force. This makes it possible to prevent the occurrence of permanent strain and cracking associated with local deformation in the composite elastic body 10. Thus, the amount of pressing against the composite elastic body 10 can be increased, the bulge amount of the tube body 5 can be increased, and the wall surface body 1 and the tube body 5 can be firmly joined.

The portion receiving a pressing force in the composite elastic body 10 is formed of flat surfaces (the first end surface 11 and the second end surface 12). Thus, the composite elastic body 10 can uniformly receive the pressing force on the flat surfaces (the first end surface 11 and the second end surface 12). Thus, the composite elastic body 10 can be uniformly deformed.

Since the first edge 14 and the second edge 15 of the composite elastic body 10 to which a large force is applied in pressing are formed of the first elastic body 100, local and large deformation of the composite elastic body 10 can be prevented. Thus, the amount of pressing against the composite elastic body 10 can be increased, the bulge amount of the tube body 5 can be increased, and the wall surface body 1 and the tube body 5 can be firmly joined.

A part of a portion where the composite elastic body 10 and the tube body 5 are in contact with each other is formed of the second elastic body 200 having a relatively small friction coefficient. Thus, the frictional force generated between the composite elastic body 10 and the tube body 5 can be reduced. Thus, it is possible to prevent the composite elastic body 10 from being unintentionally deformed by the frictional force, and thus, a larger pressing force can be applied to the composite elastic body 10. Thus, the bulge amount of the tube body 5 can be increased, and the wall surface body 1 and the tube body 5 can be firmly joined.

Frictional force is generated perpendicular to the direction of the pressing force on the first end surface 11 and the second end surface 12 that receive the pressing force. This frictional force prevents deformation of the first end surface 11 and the second end surface 12 in a direction perpendicular to the axis L of the composite elastic body 10. Forming at least a part of the first end surface 11 and the second end surface 12 with the second elastic body 200 can reduce the frictional force and increase the amount of deformation of the first end surface 11 and the second end surface 12 in the direction perpendicular to the axis L of the composite elastic body 10. Thus, the amount of deformation of the first end surface 11 and the second end surface 12 that are relatively difficult to deform can be increased, and thus, the tube body 5 can be uniformly deformed.

Since the sectional shape of the second elastic body 200 is a semicircular shape, the boundary between the first elastic body 100 and the second elastic body 200 is formed of a curved surface, and stress concentration at the boundary can be reduced. Assuming that a corner portion is provided at the boundary between the first elastic body 100 and the second elastic body 200, stress concentrates on the corner portion at the time of pressing, and the first elastic body 100 or the second elastic body 200 may be cracked. Since the boundary between the first elastic body 100 and the second elastic body 200 is formed of a curved surface, stress concentration is reduced, which prevents occurrence of cracking. Thus, the durability of the composite elastic body 10 can improve.

Figure 6:
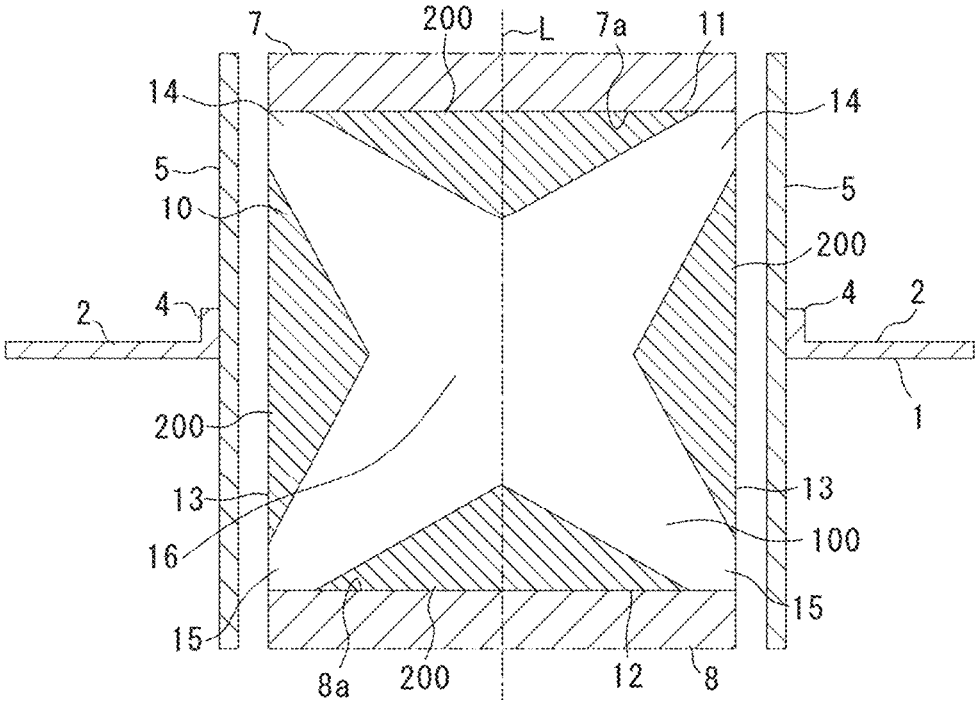
FIG. 6 is a sectional view showing a first modification of the composite elastic body of FIG. 5.

With reference to FIG. 6, in a first modification of the composite elastic body 10 according to the present embodiment, the sectional shape of the second elastic body 200 is a triangle. Thus, the shapes of the first elastic body 100 and the second elastic body 200 become simple, and manufacturing can be facilitated.

Figure 7:
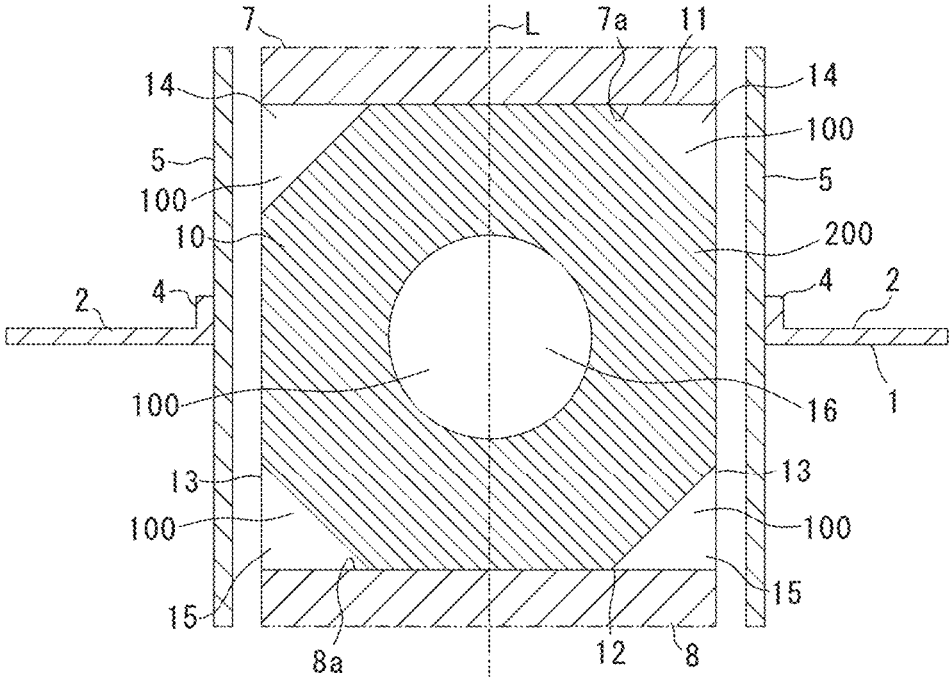
FIG. 7 is a sectional view showing a second modification of the composite elastic body of FIG. 5.

With reference to FIG. 7, in a second modification of the composite elastic body 10 according to the present embodiment, the first elastic body 100 is disposed at the first edge 14, the second edge 15, and the central portion 16 of the composite elastic body 10. In the present modification, the first elastic body 100 disposed at the central portion 16 of the composite elastic body 10 is spherical. Thus, the shapes of the first elastic body 100 and the second elastic body 200 become simple, and manufacturing can be facilitated.

Figure 8:
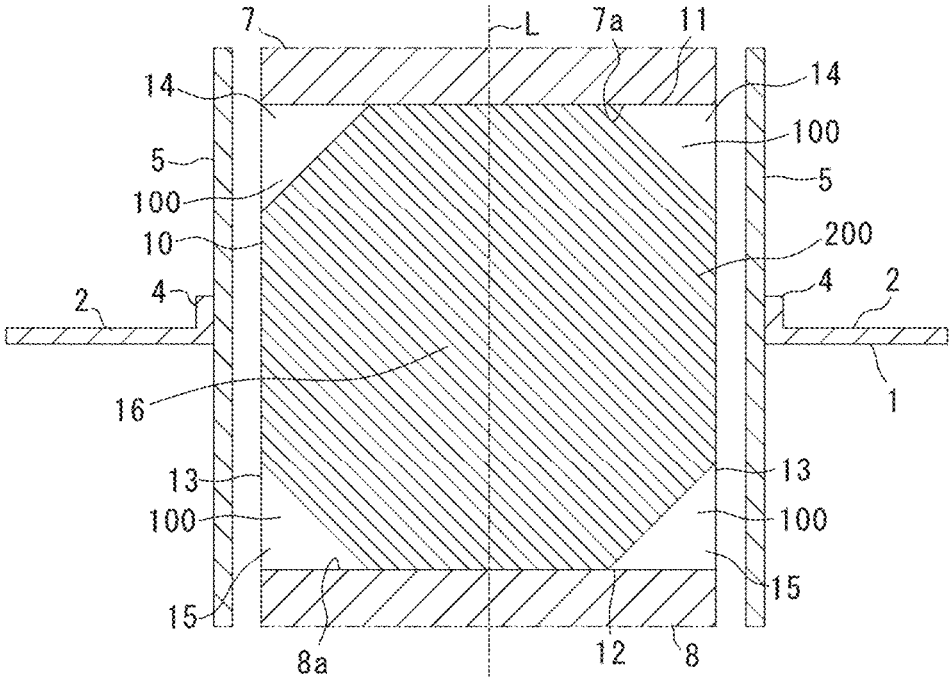
FIG. 8 is a sectional view showing a third modification of the composite elastic body of FIG. 5

With reference to FIG. 8, in a third modification of the composite elastic body 10 according to the present embodiment, the first elastic body 100 is disposed only at the first edge 14 and the second edge 15. Thus, the structure of the composite elastic body 10 becomes simple, and manufacturing can be facilitated. The sectional shape of the first elastic body 100 is a triangle. Thus, the shapes of the first elastic body 100 and the second elastic body 200 become simple, and manufacturing can be facilitated.

Second Embodiment

A method for joining members in a second embodiment will be described with reference to FIGS. 9 and 10.

Figure 9:
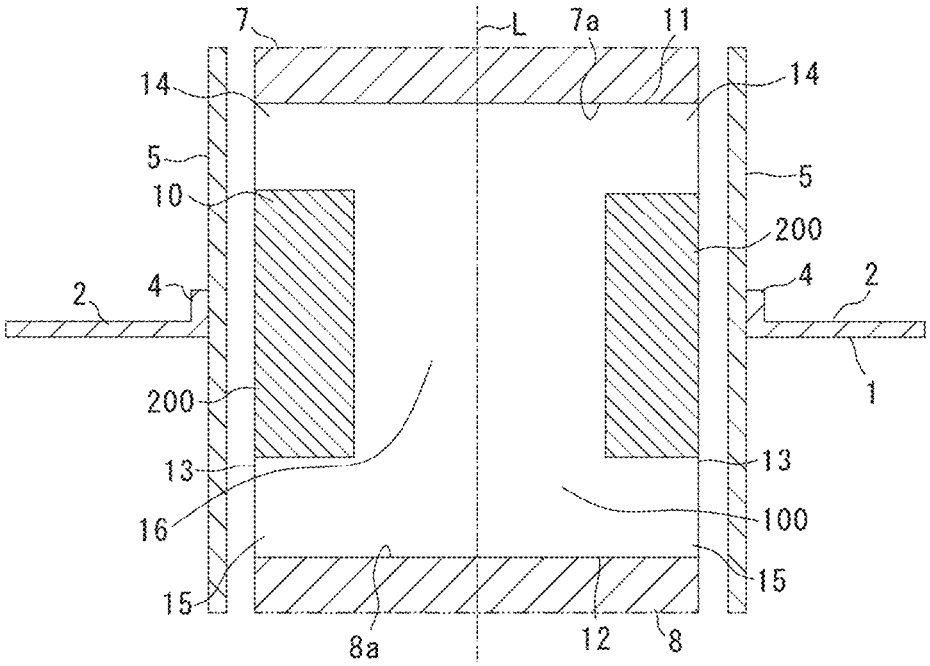
FIG. 9 is a sectional view of a composite elastic body according to a second embodiment of the present invention, which is taken in the same manner as FIG. 5.
Figure 10:
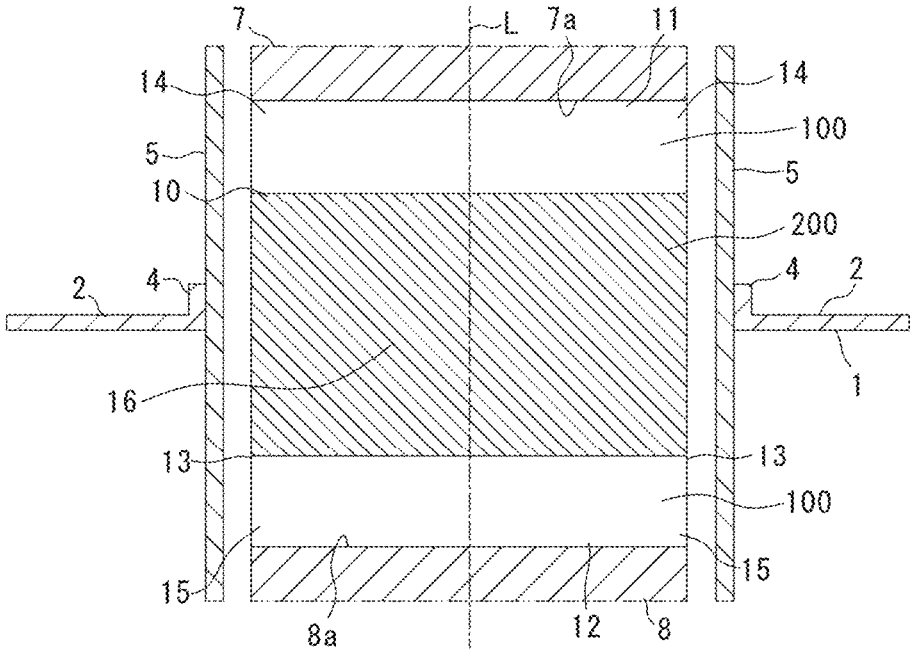
FIG. 10 is a sectional view showing a modification of the composite elastic body of FIG. 9.

The second embodiment shown in FIGS. 9 and 10 is substantially the same as the first embodiment except for the composite elastic body 10. Thus, the description of the parts shown in the first embodiment may be omitted.

With reference to FIG. 9, in the composite elastic body 10 according to the second embodiment, the first elastic body 100 constitutes the entire first end surface 11 and the entire second end surface 12. The second elastic body 200 is annularly disposed so as to constitute a part of the side surface 13.

With reference to FIG. 10, in a modification of the composite elastic body 10 according to the second embodiment, the first elastic body 100 constitutes the entire first end surface 11 and the entire second end surface 12. The second elastic body 200 has a circular columnar shape, and is disposed so as to be vertically sandwiched by the first elastic body 100. Also in the present modification, the second elastic body 200 constitutes a part of the side surface 13.

In the composite elastic body 10 according to the second embodiment, the entire first end surface 11 and the entire second end surface 12 are the first elastic body 100. Thus, even when the pusher 7 and the receiver 8 are too smaller than the diameter of the tube body 5, that is, even when the gap between the pusher 7 and the receiver 8 and the tube body 5 is large, it is possible to sufficiently press the tube body 5 while preventing local deformation from occurring in the gap. In addition, since the number of parts is reduced and the structure is simple, manufacturing can be facilitated.

Third Embodiment

A method for joining members in a third embodiment will be described with reference to FIG. 11.

Figure 11:
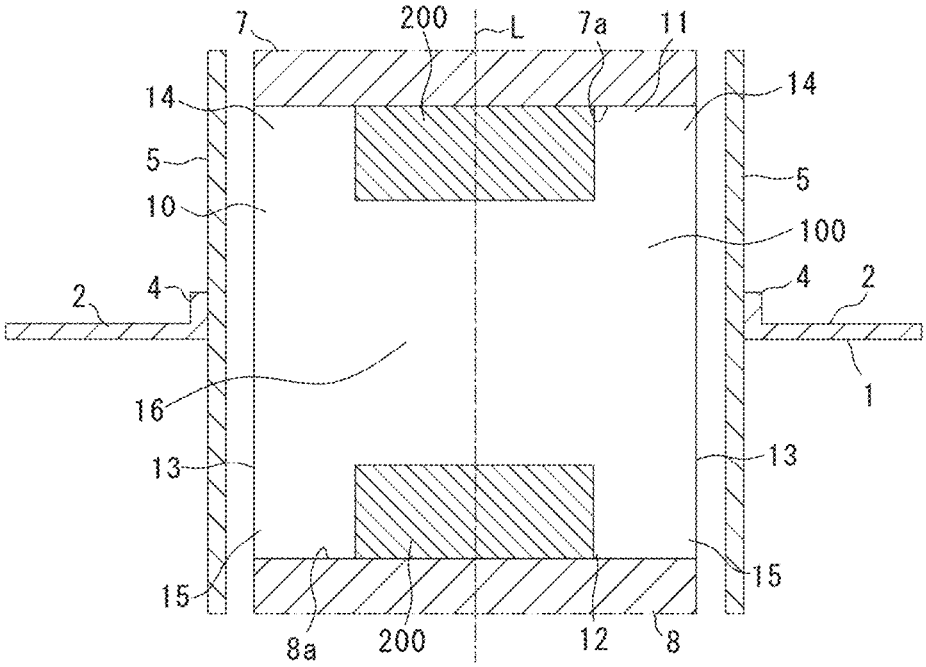
FIG. 11 is a sectional view of a composite elastic body according to a third embodiment of the present invention, which is taken in the same manner as FIG. 5.

The third embodiment shown in FIG. 11 is substantially the same as the first embodiment except for the composite elastic body 10. Thus, the description of the parts shown in the first embodiment may be omitted.

In the composite elastic body 10 according to the third embodiment, the first elastic body 100 constitutes the entire side surface 13. The second elastic body 200 has a circular columnar shape and constitutes a part of the first end surface 11 and a part of the second end surface 12.

In the composite elastic body 10 according to the third embodiment, the frictional force in the direction perpendicular to the axis L generated in the first end surface 11 and the second end surface 12 can be reduced. Thus, the amount of deformation of the first end surface 11 and the second end surface 12 in the direction perpendicular to the axis L of the composite elastic body 10 can be increased. Thus, the amount of deformation of the first end surface 11 and the second end surface 12 that are relatively difficult to deform can be increased, and thus, the tube body 5 can be uniformly deformed.

Fourth Embodiment

A method for joining members in a fourth embodiment will be described with reference to FIG. 12.

Figure 12:
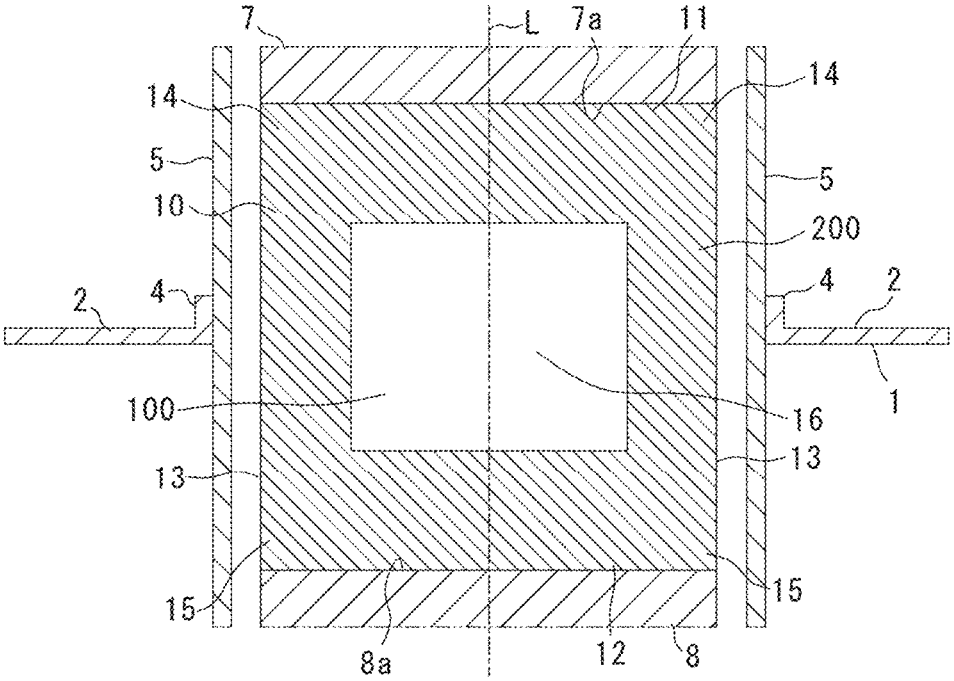
FIG. 12 is a sectional view of a composite elastic body according to a fourth embodiment of the present invention, which is taken in the same manner as FIG. 5.

The fourth embodiment shown in FIG. 12 is substantially the same as the first embodiment except for the composite elastic body 10. Thus, the description of the parts shown in the first embodiment may be omitted.

In the composite elastic body 10 according to the fourth embodiment, the second elastic body 200 is disposed so as to cover the entire surface of the first elastic body 100 having a circular columnar shape. That is, the second elastic body 200 is disposed so as to constitute the entire first end surface 11, the entire second end surface 12, and the entire side surface 13.

In the composite elastic body 10 according to the fourth embodiment, since the second elastic body 200 is disposed so as to constitute the entire first end surface 11 and the entire second end surface 12, the frictional force in the first end surface 11 and the second end surface 12 can be greatly reduced. Thus, in the composite elastic body 10, the amount of deformation in the direction perpendicular to the axis L can be increased in the first end surface 11 and the second end surface 12, and the tube body 5 can be uniformly deformed. In addition, since the second elastic body 200 is disposed so as to constitute the entire side surface 13, the frictional force on the side surface 13 can be greatly reduced. Thus, it is possible to prevent the composite elastic body 10 from being unintentionally deformed by the frictional force on the side surface 13. Thus, the bulge amount of the tube body 5 can be increased, and the wall surface body 1 and the tube body 5 can be firmly joined.

Fifth Embodiment

A method for joining members in a fifth embodiment will be described with reference to FIG. 13.

Figure 13:
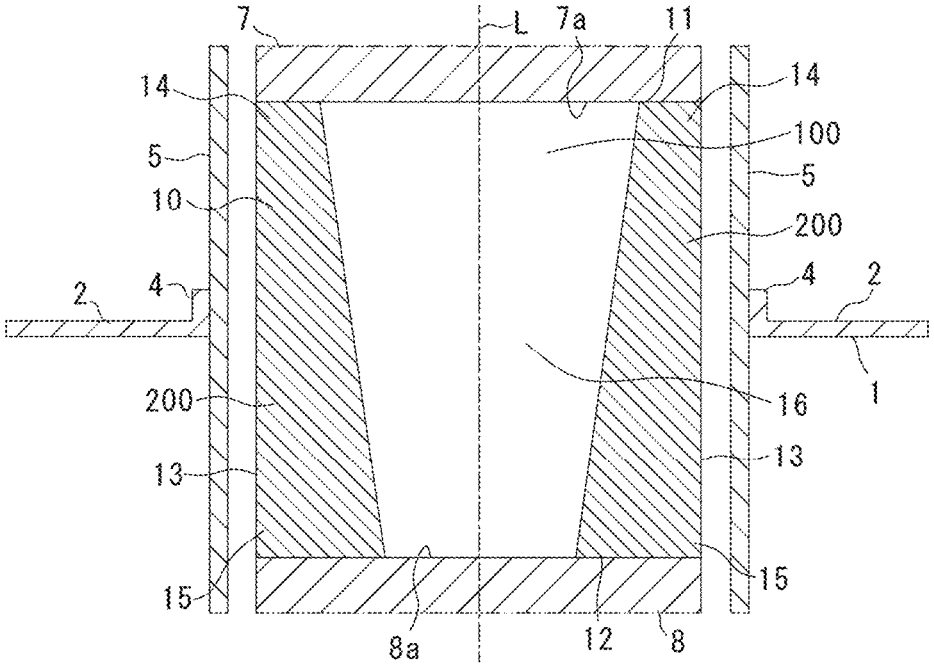
FIG. 13 is a sectional view of a composite elastic body according to a fifth embodiment of the present invention, which is taken in the same manner as FIG. 5.

The fifth embodiment shown in FIG. 13 is substantially the same as the first embodiment except for the composite elastic body 10. Thus, the description of the parts shown in the first embodiment may be omitted.

In the composite elastic body 10 according to the fifth embodiment, the first elastic body 100 has a tapered circular columnar shape extending from the first end surface 11 to the second end surface 12. The second elastic body 200 is disposed around the first elastic body 100. That is, the first elastic body 100 is disposed so as to constitute the center side of the first end surface 11 up to the center side of the second end surface 12 via the central portion 16, and the second elastic body 200 is disposed so as to constitute the entire first edge 14, the second edge 15, and the side surface 13. The second elastic body 200 has a thickness increasing from the first end surface 11 toward the second end surface 12.

In the fifth embodiment, the receiver 8 is fixed. That is, the receiver 8 is not driven in the direction of the pusher 7 to press the composite elastic body 10.

According to the method using the composite elastic body 10 according to the fifth embodiment, since the second elastic body 200 is disposed at the entire side surface 13, the frictional force generated between the composite elastic body 10 and the tube body 5 is reduced, and uniform deformation of the composite elastic body 10 can be promoted. Since the pressing force applied from the pusher 7 to the composite elastic body 10 is less likely to be transmitted as it comes toward the lower side (the second end surface 12 side) because of the frictional force, the composite elastic body 10 is less likely to be deformed on the lower side. On the other hand, since the first elastic body 100 is tapered downward and the thickness of the second elastic body 200 increases toward the lower side, the rigidity of the composite elastic body 10 decreases toward the lower side. Thus, the deformation of the composite elastic body 10 on the second end surface 12 side is promoted, and thus, uniform deformation of the composite elastic body 10 can be promoted.

Sixth Embodiment

A method for joining members in the sixth embodiment will be described with reference to FIG. 14.

Figure 14:
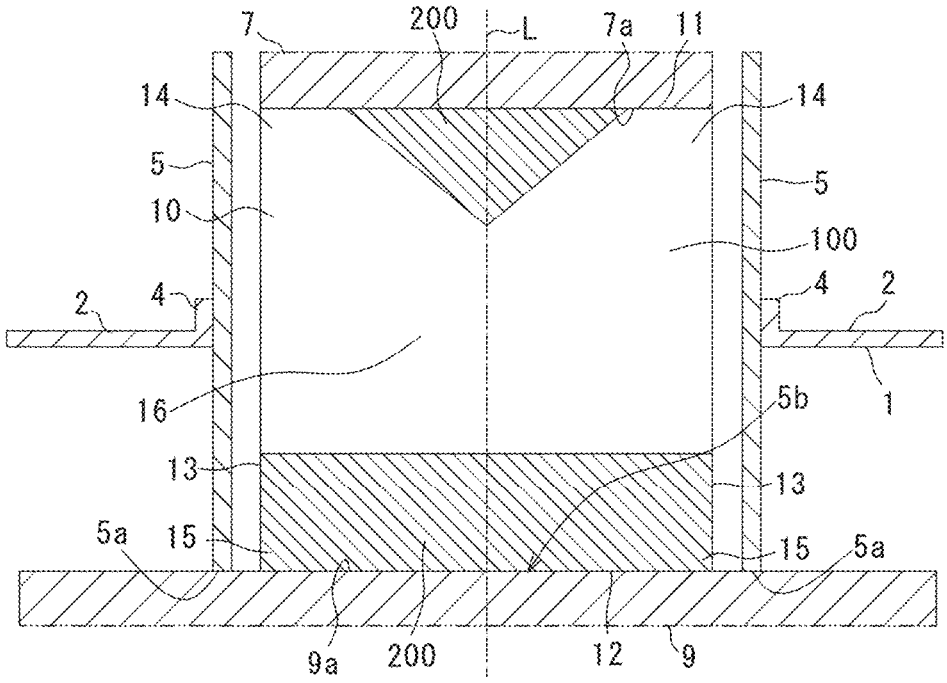
FIG. 14 is a sectional view of a composite elastic body according to a sixth embodiment of the present invention, which is taken in the same manner as FIG. 5.

The sixth embodiment illustrated in FIG. 14 is substantially the same as the first embodiment except for the composite elastic body 10 and the receiver 8. Thus, the description of the parts shown in the first embodiment may be omitted.

In the composite elastic body 10 according to the sixth embodiment, the second elastic body 200 is formed in a circular shape from a part of the first end surface 11, specifically, from the center of the first end surface 11. That is, on the first end surface 11, the first elastic body 100 and the second elastic body 200 form concentric circles. The lower portion of the composite elastic body 10 is formed of the second elastic body 200. That is, the second elastic body 200 constitutes the entire second end surface 12.

In the sixth embodiment, a receiver 9 is positionally fixed and has a fixing surface 9*a* larger than the diameter of the tube body 5. At the time of pressing, the lower surface 5*a* of the tube body 5 and the second end surface 12 of the composite elastic body 10 are disposed flush with each other on the fixing surface 9*a* of the receiver 9. In this disposition state, the pusher 7 is lowered downward, and the composite elastic body 10 is pressed in such a manner as to be sandwiched between the pusher 7 and the receiver 8. Since the tube body 5 is placed on the fixing surface 9*a*, an opening 5*b* on the lower side of the tube body 5 is closed by the fixing surface 9*a*. Alternatively, the receiver 9 may be replaced with a floor surface or a fixing base.

According to the method using the composite elastic body 10 according to the sixth embodiment, uniform deformation of the composite elastic body 10 can be promoted. In pressing from above (first end surface 11 side), the first end surface (upper surface) 11 receives a relatively large force, and the second end surface (lower surface) 12 receives a relatively small force. The second elastic body 200 constitutes the entire second end surface 12 and a part of the first end surface 11 in accordance with such a difference in relative received force. That is, the proportion of the second elastic body 200 is larger on the second end surface 12 side than on the first end surface 11 side. Thus, uniform deformation of the composite elastic body 10 can be promoted.

The invention claimed is:

1. A method for joining members, the method comprising:

preparing a first member provided with a hole, a second member having a tubular shape, and a composite elastic body obtained by combining at least two types of elastic bodies having different hardness;

inserting the second member into the hole of the first member;

inserting the composite elastic body into the second member; and pressing the composite elastic body to cause the second member to bulge out, thereby joining the first member and the second member by press-fitting, wherein the composite elastic body has a columnar shape including a first end surface having a flat shape and a second end surface having a flat shape, the first end surface and the second end surface receiving a pressing force in such a manner as to be sandwiched, and a side surface connecting the first end surface and the second end surface, the composite elastic body includes a first elastic body having relatively high hardness and a second elastic body having relatively low hardness, and the first elastic body constitutes a first edge that is a connecting portion between the first end surface and the side surface, and a second edge that is a connecting portion between the second end surface and the side surface.

2. The method for joining members according to claim 1, wherein the second elastic body constitutes at least a part of the side surface.

3. The method for joining members according to claim 2, wherein the second elastic body constitutes at least a part of the first end surface and at least a part of the second end surface.

4. The method for joining members according to claim 2, wherein a boundary between the first elastic body and the second elastic body is formed of a curved surface.

5. The method for joining members according to claim 1, wherein the second elastic body constitutes at least a part of the first end surface and at least a part of the second end surface.

6. The method for joining members according to claim 1, wherein a boundary between the first elastic body and the second elastic body is formed of a curved surface.

7. A method for joining members, the method comprising:

preparing a first member provided with a hole, a second member having a tubular shape, and a composite elastic body obtained by combining at least two types of elastic bodies having different hardness;

inserting the second member into the hole of the first member;

inserting the composite elastic body into the second member; and pressing the composite elastic body to cause the second member to bulge out, thereby joining the first member and the second member by press-fitting, wherein the composite elastic body has a columnar shape including a first end surface having a flat shape and a second end surface having a flat shape, the first end surface and the second end surface receiving a pressing force in such a manner as to be sandwiched, and a side surface connecting the first end surface and the second end surface, and the composite elastic body includes a first elastic body having relatively high hardness and a second elastic body having relatively low hardness, the method further comprising preparing a pusher that includes a drive surface for pressing the first end surface and is driven in a direction perpendicular to the first end surface, and a receiver that includes a fixing surface for supporting the second end surface and is positionally fixed; and pressing the composite elastic body to sandwich the composite elastic body between the drive surface of the pusher and the fixing surface of the receiver, wherein the first elastic body has a tapered columnar shape extending from the first end surface to the second end surface, and the second elastic body is disposed around the first elastic body and constitutes a whole of the side surface.

8. A method for joining members, the method comprising:

preparing a first member provided with a hole, a second member having a tubular shape, and a composite elastic body obtained by combining at least two types of elastic bodies having different hardness;

inserting the second member into the hole of the first member;

inserting the composite elastic body into the second member; and pressing the composite elastic body to cause the second member to bulge out, thereby joining the first member and the second member by press-fitting, wherein the composite elastic body has a columnar shape including a first end surface having a flat shape and a second end surface having a flat shape, the first end surface and the second end surface receiving a pressing force in such a manner as to be sandwiched, and a side surface connecting the first end surface and the second end surface, and the composite elastic body includes a first elastic body having relatively high hardness and a second elastic body having relatively low hardness, the method further comprising preparing a pusher that includes a drive surface for pressing the first end surface and is driven in a direction perpendicular to the first end surface, and a receiver that includes a fixing surface for supporting the second end surface and is positionally fixed;

disposing a lower surface of the second member and the second end surface of the composite elastic body to make the lower surface and the second end surface flush with each other on the fixing surface of the receiver; and pressing the composite elastic body to sandwich the composite elastic body between the drive surface of the pusher and the fixing surface of the receiver, wherein the second elastic body constitutes a whole of the second end surface and a part of the first end surface.

9. A composite elastic body disposed in a second member and pressed in a state where the second member is inserted into a hole of a first member, the composite elastic body causing the second member to bulge out, to join the first member provided with the hole and the second member having a tubular shape by press-fitting, the composite elastic body comprising at least two types of elastic bodies having different hardness, wherein the composite elastic body has a columnar shape including a first end surface having a flat shape and a second end surface having a flat shape, the first end surface and the second end surface receiving a pressing force in such a manner as to be sandwiched, and a side surface connecting the first end surface and the second end surface, the composite elastic body includes a first elastic body having relatively high hardness and a second elastic body having relatively low hardness, and the first elastic body constitutes a first edge that is a connecting portion between the first end surface and the side surface, and a second edge that is a connecting portion between the second end surface and the side surface.

* * * * *